US006345491B1

(12) United States Patent
Moran et al.

(10) Patent No.: US 6,345,491 B1
(45) Date of Patent: Feb. 12, 2002

(54) FLUID-JET TWIST-INSERTING METHOD

(75) Inventors: Kevin E. Moran, Belmont; Kurt Willy Niederer, Charlotte, both of NC (US); Robert Edward Taylor, Columbia, SC (US); Ralph Samuel Jenkins, Gastonia; Jeffrey Todd Rhyne, Belmont, both of NC (US)

(73) Assignee: Belmont Textile Machinery Co., Inc., Mount Holly, NC (US)

( * ) Notice: Subject to any disclaimer, the term of this patent is extended or adjusted under 35 U.S.C. 154(b) by 0 days.

(21) Appl. No.: 09/549,747

(22) Filed: Apr. 14, 2000

Related U.S. Application Data

(63) Continuation of application No. 09/103,947, filed on Jun. 24, 1998, now Pat. No. 6,052,983.

(51) Int. Cl.[7] ..... D01H 13/26

(52) U.S. Cl. ..... 57/333; 57/282; 57/284; 57/289; 57/293; 57/294; 57/304; 57/305; 57/332; 57/350; 57/351; 57/908

(58) Field of Search ..... 57/282, 284, 289, 57/293, 294, 304, 305, 332, 333, 350, 351, 908

(56) References Cited

U.S. PATENT DOCUMENTS 3,650,103 A 3/1972 Farrar et al.
4,055,039 A 10/1977 Movshovich et al.
4,148,179 A 4/1979 Becker et al.
5,228,282 A 7/1993 Tinsley et al.
5,619,848 A * 4/1997 Costales et al. ..... 57/261
6,052,983 A * 4/2000 Moran et al. ..... 57/293

* cited by examiner

*Primary Examiner*—John J. Calvert
*Assistant Examiner*—Shaun R Hurley
(74) *Attorney, Agent, or Firm*—Adams, Schwartz & Evans, P.A.

(57) ABSTRACT

An apparatus for inserting twist into a moving strand, including a first body including an orifice extending therethrough for permitting passage of a moving yarn. An air channel extends therethrough and communicates with the orifice. The air channel communicates with the orifice at a tangentially-offset angle to the path of the yarn through the orifice to create a cyclonic air circulation pattern in the orifice to insert a predetermined direction of twist into the yarn as the yarn passes through the orifice. The first body is adapted for being inverted relative to, and placed in overlying registration with, a second like body whereby the air channel of the first body inserts one predetermined direction of twist into the yarn and the air channel of the second body inserts another predetermined direction of twist into the yarn.

11 Claims, 17 Drawing Sheets

OFFSET DOUBLE-HOLE

FLUID-JET TWIST-INSERTING METHOD

This is a 1.53(b) continuation application of U.S. Ser. No. 09/103,947 filed on Jun. 24, 1998 now U.S. Pat. No. 6,052,983.

TECHNICAL FIELD AND BACKGROUND OF THE INVENTION

This invention relates to an apparatus and method for twisting individual strands of yarn and plying these individually twisted strands around each other, and the yarn made according to the method. More specifically, this twisting action is accomplished by false-twisting, where for a certain yarn length the yarn is twisted a number of turns in one direction and then for another sequential length, it is twisted in the opposite direction. The application also discloses yarns produced according to the method and on an apparatus of the type described.

The nature of false twisting is such that the total number of turns in one direction minus the total number of turns in the opposite direction over the total yarn-length is zero. The method of taking several twisted yarns and combining them by twisting them together to make a multi-stranded yarn has been known for thousands of years. However, plying previously-twisted yarns together is energy and time-consuming, since for every turn in the individual yarn and also for every turn in the plied multi-stranded yarn, the yarn packages must be turned around their axis.

The apparatus and method according to the invention is much more economical since only a relatively short piece of each yarn is twisted around its own axis. The secondary plying occurs automatically since, through the inserted torque, the twisted yarns in the single yarn twist around each other in the direction of the yarn-torque.

The twist-inserting apparatus according to the invention is a simple and unique way of providing a twist-inserting jet of air to the moving yarn which is highly precise and reliable, and easily modified when changes in yarn construction or twist characteristics require.

SUMMARY OF THE INVENTION

It is therefore an object of the invention to provide a fluid-jet twist-inserting apparatus for inserting twist into a multi-stranded, plied yarn. Twist is inserted by twisting a section of a given length of each individual strand around its own axis where the downstream sides of the yarns have twist in one direction and the upstream sides have the same amount of opposite twist. The twist direction is alternated periodically, whereby at twist reversal locations the fibers of the individual yarns are "tacked" by, for example, a fluid jet such as an air-jet entangler.

It is another object of the invention to apply the twist to the individual yarns with stationary twisting elements as the yarns travel past the stationary twisting elements, whereby the direction of twist is periodically reversed.

It is another object of the invention to control the insertion of twist by means of compressed air supplied by twist-inserting air-jets connected to solenoid valves, which are controlled through an electronic controller.

It is another object of the invention to provide that the amount of twist in one or more yarns are varied over the length of the plied yarn.

It is another object of the invention to provide a twist-inserting apparatus which makes use of a limited number of identical or similar disks.

It is another object of the invention to provide a twist-inserting apparatus wherein the amount of air being applied to the yarn can be varied by adding or removing one or more like components.

It is another object of the invention to provide a twist-inserting apparatus which is compact and has no moving parts.

These and other objects of the present invention are achieved in the preferred embodiments disclosed below by providing an apparatus for inserting twist into a moving strand, comprising a first body which has an orifice extending therethrough for permitting passage of a moving yarn, and has an air channel extending therethrough and communicating with the orifice.

The air channel communicates with the orifice at a tangentially-offset angle to the path of the yarn through the orifice to create a cyclonic air circulation pattern in the orifice to insert a predetermined direction of twist into the yarn as the yarn passes through the orifice. The first body is adapted for being inverted relative to, and placed in overlying registration with, a second like body whereby the air channel of the first body inserts one predetermined direction of twist into the yarn and the air channel of the second body inserts another predetermined direction of twist into the yarn.

According to one preferred embodiment of the invention, the first body is disk-shaped, the orifice extends in an axial direction through the body, and at least a portion of the air channel extends radially through the body.

According to another preferred embodiment of the invention, the disk includes a plurality of spaced-apart orifices and a plurality of air channels, one of the plurality of air channels communicating with a respective one of the orifices.

According to yet another preferred embodiment of the invention, the orifices are clustered in a central area of the body and the air channels extend radially inwardly towards the orifices from a peripheral area of the body.

Preferably, at least four symmetrically-spaced orifices are formed in the body, and at least four air channels extend radially-inwardly from a peripheral area of the body into communication with a respective one of the orifices.

Preferably, each of the air channels intersects the respective orifices at a right angle to the direction of yarn travel.

According to yet another preferred embodiment of the invention, selection means are provided for selecting one or the other of the first body or second body air channels to deliver air to the respective first or second orifice and thereby insert a predetermined direction of twist into the yarn.

According to yet another preferred embodiment of the invention, the first body comprises a circular disk having opposed first and second major surfaces. The apparatus also includes a top end block and a bottom end block between which the first and second disks are sandwiched, and air supply ports extending through the top end block and communicating with respective air channels in the first and second disks.

According to yet another preferred embodiment of the invention, the air channels extend through the thickness of the body and communicate with the opposed first and second major surfaces.

According to another preferred embodiment of the invention, the air channel communicates with the orifice through a respective air channel nozzle, and the area defined by the opening of the nozzle into the orifice is no more than one/fourth of the area of the orifice.

According to yet another preferred embodiment of the invention, the air channel communicates with the orifice through a respective air channel nozzle, and the area defined by the opening of the nozzle into the orifice is about one sixth of the area of the orifice.

According to yet another preferred embodiment of the invention, the air channel communicates with the orifice through a respective air channel nozzle, and the width of the nozzle is no more than one half of the width of the air channel.

According to yet another preferred embodiment of the invention, the air channel communicates with the orifice through a respective air channel nozzle, and wherein the width of the nozzle is no more than about one third of the width of the air channel.

According to another preferred embodiment of the invention, an apparatus for inserting twist into a moving strand comprises a first body, which includes an orifice extending therethrough for permitting passage of a moving yarn, an air channel extending therethrough and communicating with the orifice. The air channel communicates with the orifice at a tangentially-offset angle to the path of the yarn through the orifice to create a cyclonic air circulation pattern in the orifice to insert a predetermined direction of twist into the yarn as the yarn passes through the orifice. A second body is provided, which includes an orifice extending therethrough for permitting passage of a moving yarn, an air channel extending therethrough and communicating with the orifice. The air channel communicates with the orifice at a tangentially-offset angle to the path of the yarn through the orifice to create a cyclonic air circulation pattern in the orifice to insert a predetermined direction of twist into the yarn as the yarn passes through the orifice. The first body is inverted relative to, and placed in overlying registration with the second body. The top and bottom end blocks enclose the first and second bodies. The top end block includes air supply ports extending therethrough which communicate with respective air channels in the first and second disks for supplying pressurized air thereto. The air channel of the first body therefore inserts one predetermined direction of twist into the yarn and the air channel of the second body inserts another predetermined direction of twist into the yarn.

Preferably, the first body and the second body comprise respective first and second disks.

According to another preferred embodiment of the invention, the first and second disks each have a predetermined thickness defining a air channel dimension.

According to yet another preferred embodiment of the invention, the apparatus is adapted to receive first and second disks having different predetermined respective thicknesses for accommodating an air channel having a larger or smaller air flow capacity whereby first and/or second disks can be substituted in the apparatus to increase or decrease the air flow capacity required for a given yarn size, configuration or level of twist insertion.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
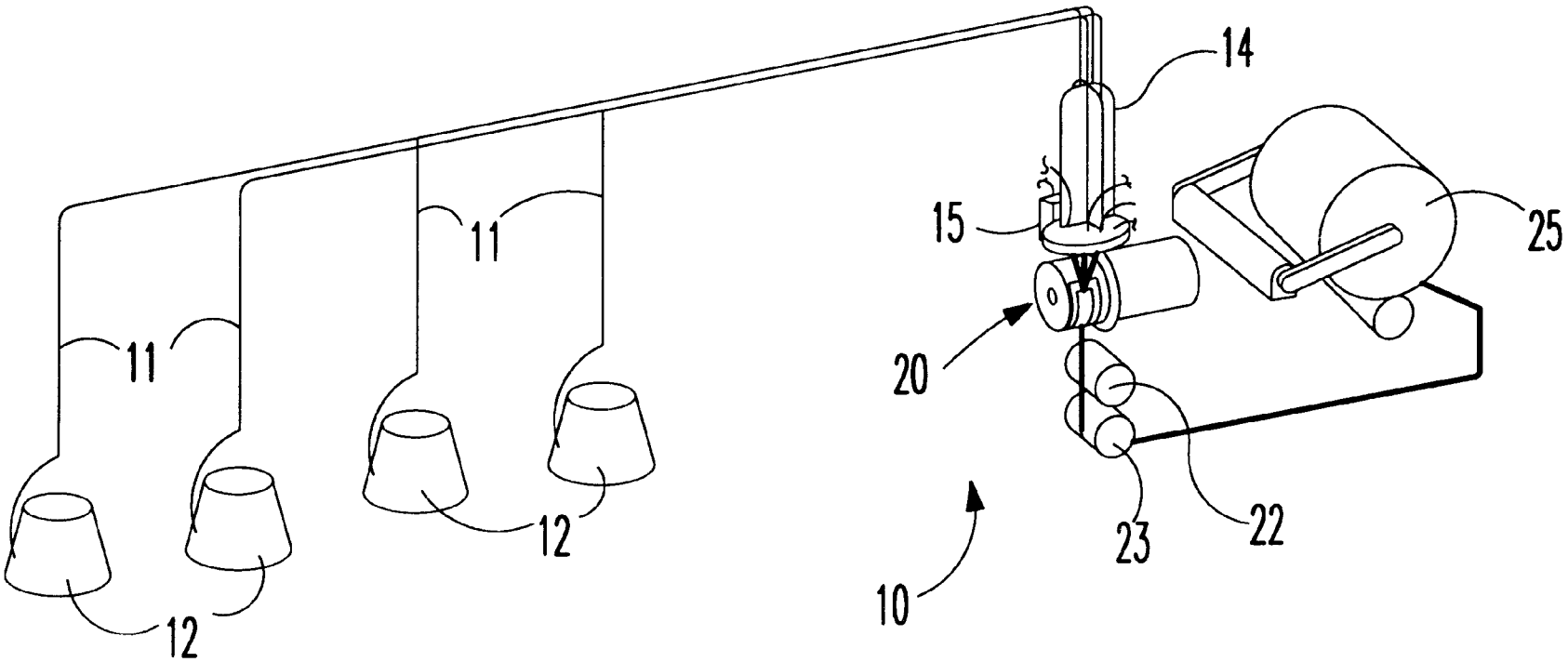
FIG. 1 is a simplified, schematic, perspective view of a fluid-jet false-twisting apparatus according to an embodiment of the present invention.

Referring now specifically to the drawings, a fluid-jet false-twisting apparatus is shown schematically in FIG. 1 and generally indicated at broad reference numeral 10. In general, multi-filament yarns 11 are taken from respective supply packages 12 and passed through a yarn separator 14, a twist-inserting apparatus 15 according to the invention of this application, a rotary air jet assembly 20, where the yarn 11 is plied by the combined action of the twist-inserting apparatus 15 and the rotary air jet assembly 20 in the manner according to the invention as described in this application. Air is supplied to the twist-inserting apparatus 15 from a source of pressurized air by means of solenoid valves controlled by mechanical, electromechanical or, preferably, electronic means (not shown). The length of the yarn upstream of the twist-inserting apparatus 15 can be less than twice the distance between each twist reversal, and in some application as low as one-to-one, a substantial advantage over prior art processes.

The yarns 11, now in plied form, are guided around overfeed drive rolls 22, 23 where the tension on the plied yarns 11 is reduced to a predetermined extent before delivery to a take-up package 25.

Figure 2:
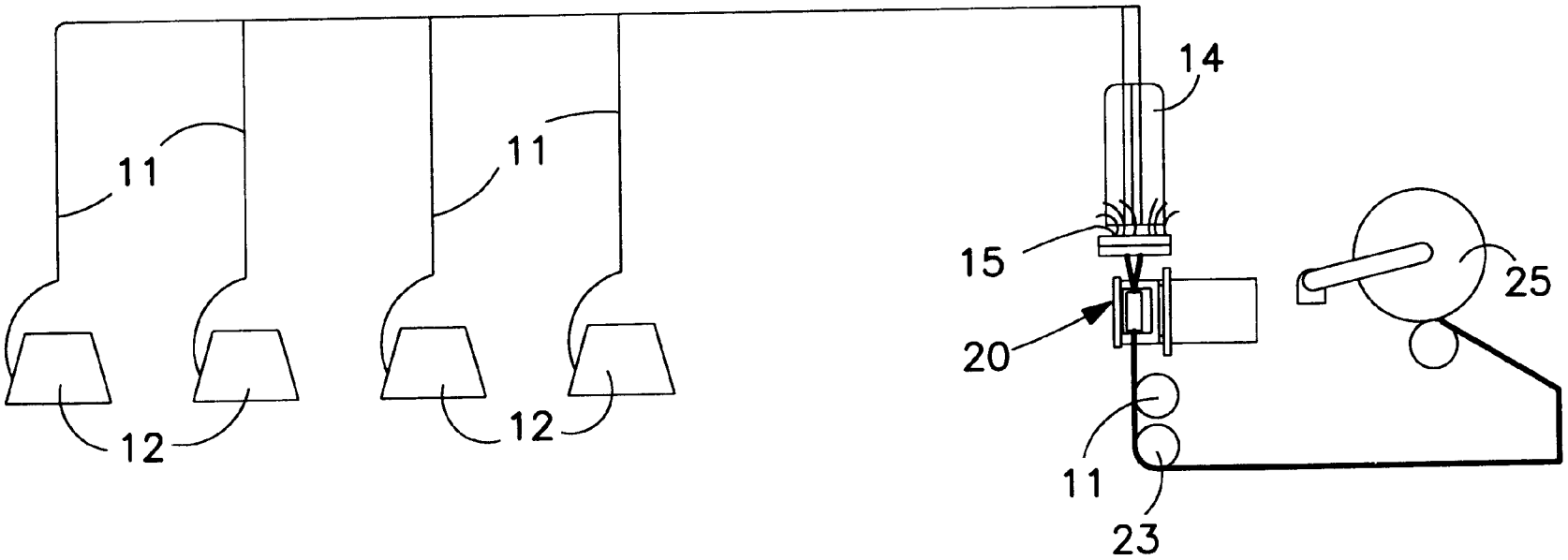
FIG. 2 is a side elevation of the embodiment of the invention shown in FIG. 1.

FIG. 2 shows the same fluid-jet false-twist apparatus 10 schematically in side elevation.

In commercial production, a predetermined number of the fluid-jet false-twist apparatuses 10 will be positioned on a single frame for simultaneous operation. The number of units 10 on a single frame may be similar to the number of units on, for example, a winder.

Figure 3:
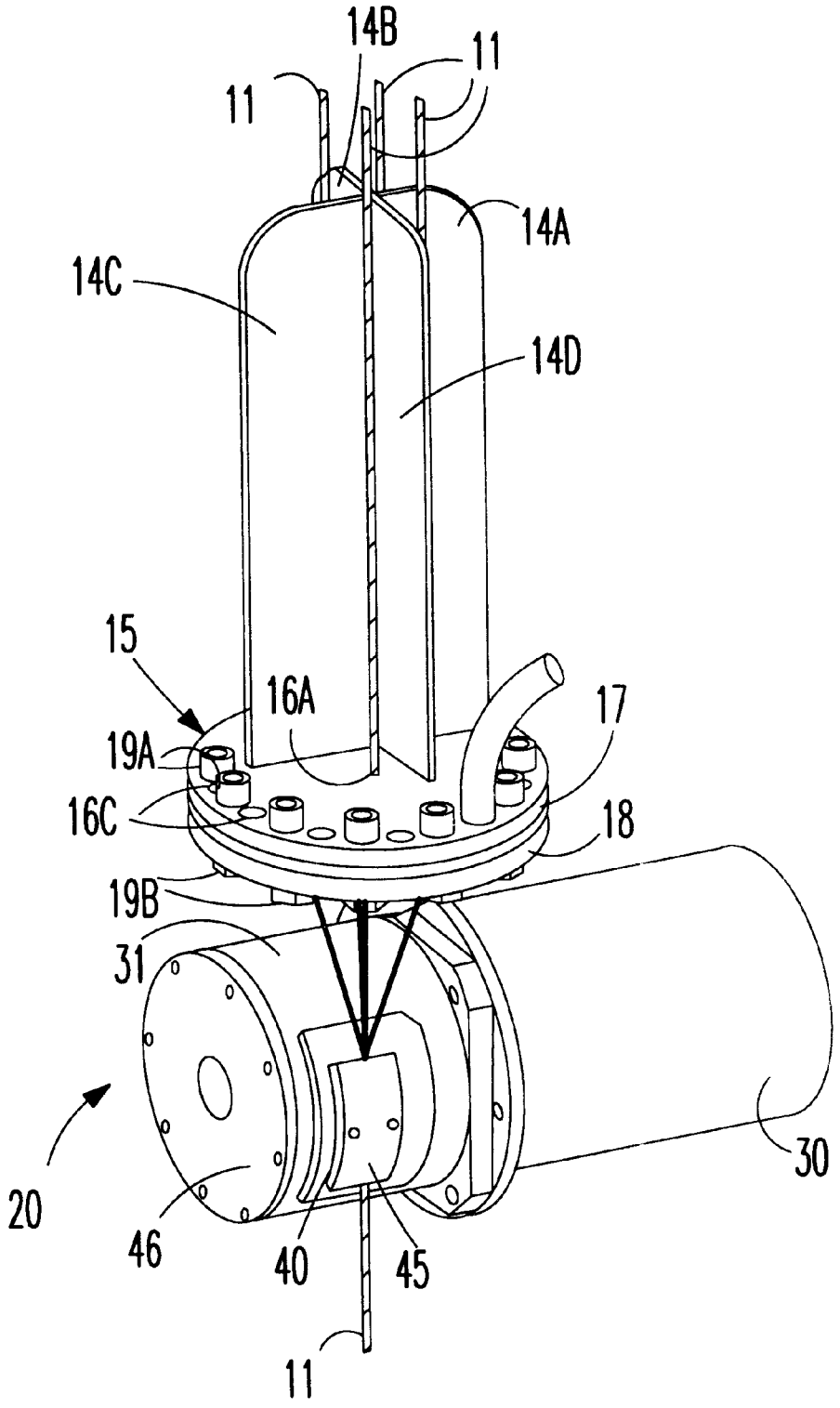
FIG. 3 shows in a close-up the twisting process according to an embodiment of the invention wherein four yarns are false-twisted.

Referring now to FIG. 3, the yarn separator 14 has four elongate, vertically-oriented wings 14A–14D. The wings 14A–14D separate the yarn path into four physically-separate zones and thereby keep the individual yarns 11 from touching and twisting together prior to passage into the twist-inserting apparatus 15. As shown in FIG. 3, the yarns 11 above the twist-inserting apparatus 15 are twisted in a Z-direction; the yarns 11 between the twist-inserting apparatus 15 and the rotary air-jet assembly 20 are twisted in S-direction; and the plied yarn 11 below the rotary air-jet assembly 20 are twisted in Z-direction. Sufficient yarn length is needed upstream of the twist-inserting apparatus 15 for the backed-up twist to accumulate.

Figure 4:
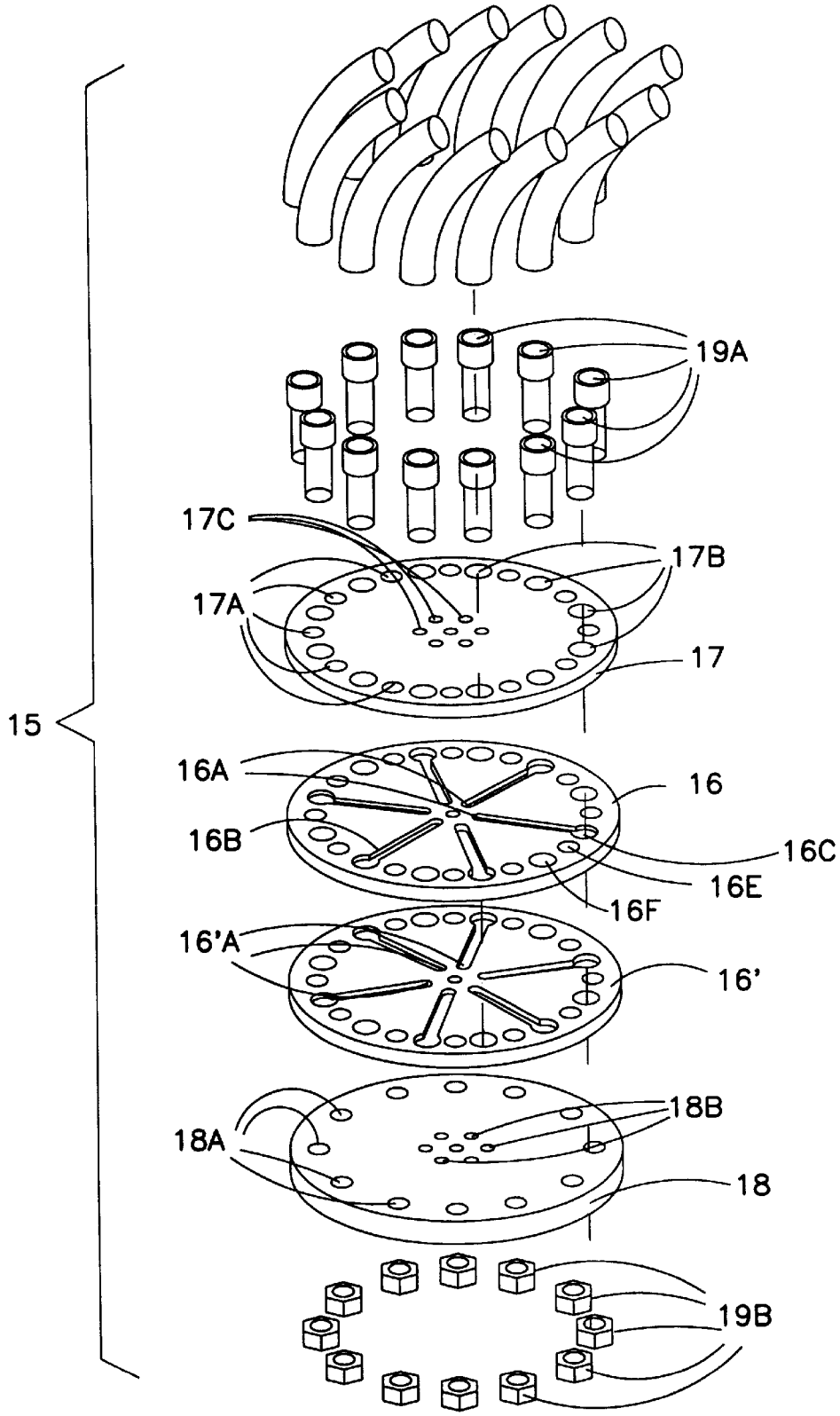
FIG. 4 is an exploded perspective view of the fluid-jet twist-inserting apparatus according to an embodiment of the invention.
Figure 5:
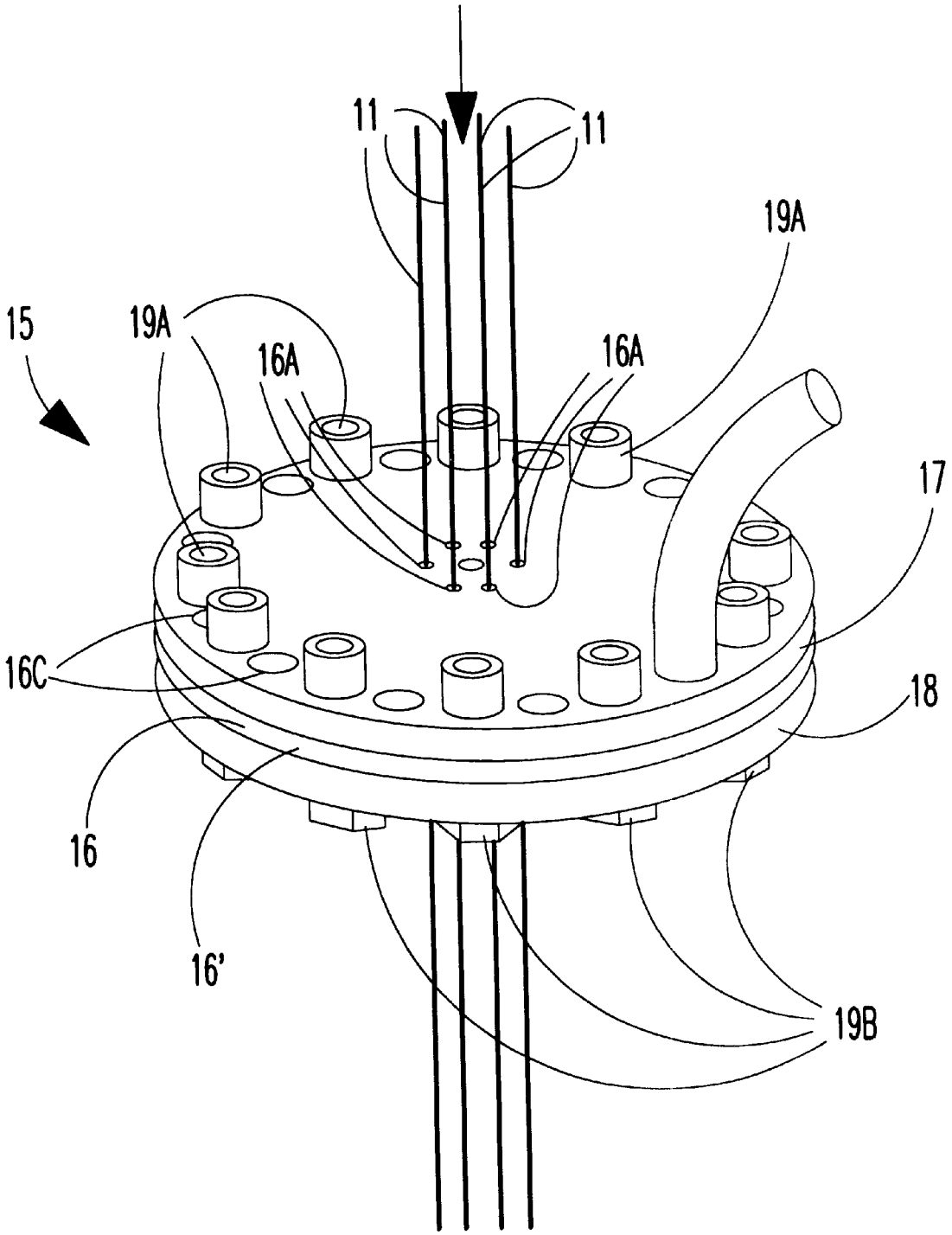
FIG. 5 is an assembled perspective view of the fluid-jet twist-inserting apparatus shown in FIG. 4, with all but one of the air supply tubes removed for clarity.

Referring now to FIGS. 4 and 5, the twist-inserting apparatus 15 is shown in an exploded and an assembled view. In general, twist-inserting apparatus 15 is formed from two identical disks 16 and 16'. A identical pattern cut into the disk 16 permits the disk 16 to be used for inserting both S-twist and Z-twist simply by inverting one disk 16 against the other. The location of the disks 16 relative to each other and the flow characteristics defined by the pattern establish the correct twist insertion.

As will be described in further detail below, each of the disks 16, 16' includes various channels, nozzles and orifices which perform the yarn-twisting function. The disks 16, 16' are placed in overlying relation to each other and sandwiched between a top end block 17 and a bottom end block 18. The blocks 17 and 18 are held together by machine screws 19A which extend through holes in the disks 16, 16' and blocks holes 17A, 18A in respective blocks 17, 18. The screws are captured by respective nuts 19B, as shown. Top block 17 functions as an air feed manifold and distributes air from a remote supply of pressurized air to the twist-inserting apparatus 15 under the control of programmed solenoids. Air hoses connect the air supply to the disks 16, 16' through air inlet holes 17B. The yarns 11 pass through yarn orifices 17C and 18B in respective blocks 17 and 18.

Thus, as is shown, the twist-inserting apparatus 15 is a compact, simple device with no moving parts and which can be quickly and reliably modified as needed.

The assembled twist-inserting apparatus is shown in FIG. 5.

Figure 8:
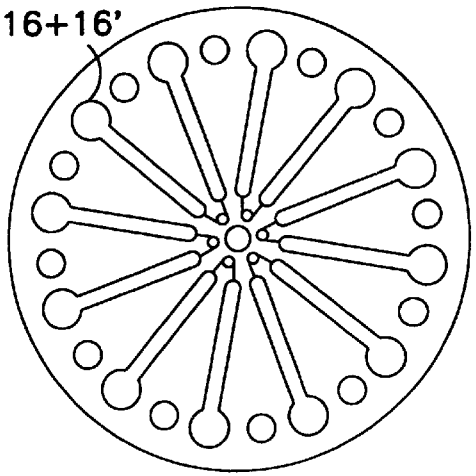
FIG. 8 is a composite view of FIGS. 6 and 7, showing the configuration when two disks are placed in registration with each other to insert alternating S- and Z-twist.
Figure 7:
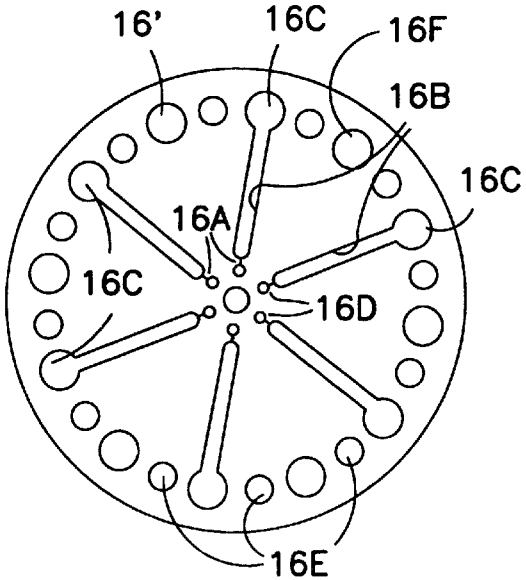
FIG. 7 is a plan view of the side of the disk opposite that shown in FIG. 6, in position to insert clockwise twist.
Figure 6:
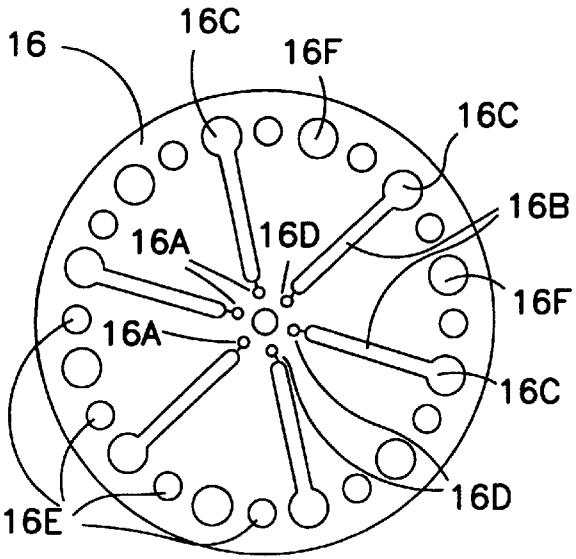
FIG. 6 is a plan view of one side of the disk shown in FIGS. 4 and 5 in position to insert counterclockwise twist.

Referring now to FIGS. 6, 7 and 8, the disk 16 is described in further detail. Disk 16 is formed from relatively thin sheet stainless steel on the order of 0.125 in. thick. In the embodiment disclosed in this applications a six-ply yarn can be processed, and for this purpose six yarn orifices 16A are formed in the central area of the disk 16. See also FIG. 5. Moving yarns pass through these orifices 16A perpendicular to the major plane of the disk 16.

Figure 9A:
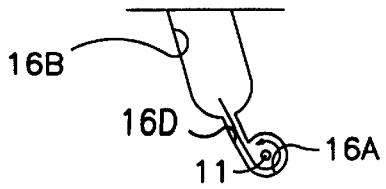
FIGS. 9A and 9B are enlarged, fragmentary views of the disk, showing details of the air channel, nozzle and yarn orifice as oriented for clockwise and counterclockwise air rotation.
Figure 9B:
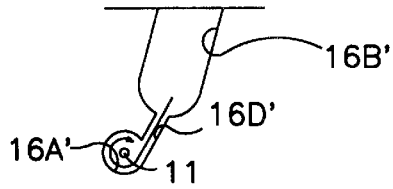

Six air channels 16B are formed in the disk 16 and extend radially-inwardly from six respective enlarged air supply holes 16C. These channels 16B communicate with the yarn orifices 16A by means of six respective nozzles 16D. This arrangement is best shown in FIGS. 9A and 9B. Note that the nozzle 16D intersects the orifice at a tangent, so that air traveling from the nozzle 16D into the orifice 16A creates a cyclonic air circulation pattern. This air movement contains sufficient energy to cause the moving yarn to be twisted about its own axis.

The orifices 16A, air channels 16B connection, air supply holes 16C and nozzles 16D are cut into the disk 16 and communicate with both major surfaces of the disk 16. Thus, the disk 16 shown in FIG. 7 is simply the inverted disk 16 shown in FIG. 6. This has the effect of reversing the tangent angle at which the air from the nozzles 16 intersect the moving yarn.

Disk 16 also has 12 screw holes 16E for receiving the screws 19, as shown in FIGS. 4 and 5. Finally, disk 16 is provided with 6 air supply holes 16F which do not interconnect with the air channels 16B of the same disk 16, but with the air supply channels 16B of an inverted disk 16', as shown in FIG. 4. This is accomplished merely by virtue of the fact that the disk 16' is inverted with respect to the other disk 16. This is illustrated in FIG. 8, where disks 16 and 16' are shown in position. The top disk 16 is shown as if it were transparent. The yarn orifices 16A are exactly aligned with each other, so that each of the six yarn strands passes through one of the aligned yarn orifices 16A in both disks 16 and 16'.

Figure 10:
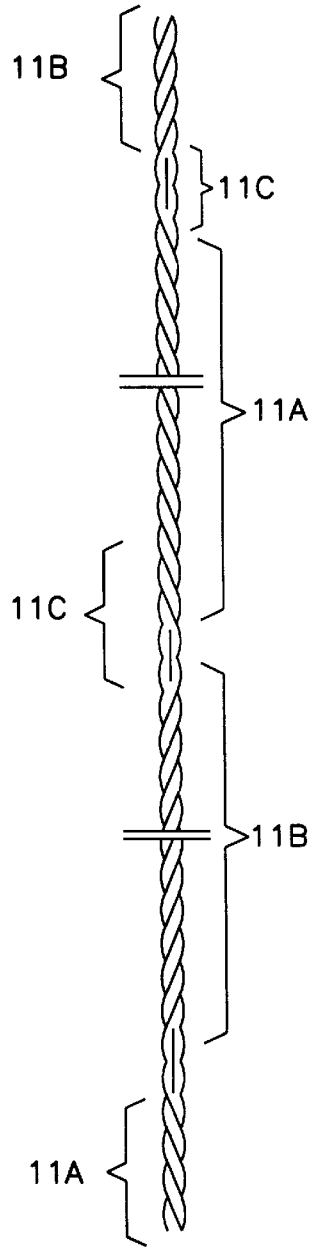
FIG. 10 is a longitudinal sectional view of a length of a plied yarn according to an embodiment of the invention.

The six air supply holes 16C in disk 16 are connected through a manifold to an air solenoid and thus operate in unison. When air is flowing through the air supply holes in disk 16, clockwise, S-twist is being inserted in the yarns. When air is flowing through the air supply holes in disk 16', counterclockwise, Z-twist is being inserted in the yarns. As described above, control of the alternating twist directions produces a false-twisted yarn with the desired characteristics, with twist reversal spots between the areas of alternating twist, as shown in FIG. 10.

Thus, 12 air supply hoses, as shown in FIG. 4, interconnect into the 12 air supply holes of disks 16 and 16'. Due to the 30 degree axial offset of the disks 16 and 16' relative to each other, six of the air channels direct air to the nozzles 16D which will insert S-twist in the yarn and six of the air channels direct air to the nozzles 16D which will insert Z-twist in the yarn.

While there are numerous possible variations in shape and the relationship between the various elements of the invention, the following represents one preferred embodiment where the various dimensions and relationships between elements have been shown to be effective:

| | |
|---|---|
| Disk 16 diameter | 3 in. |
| Disk 16 thickness | 0125 in. |
| yarn orifice 16A diameter | 0.093 in. |
| Air channel 16B width | 0.125 in. |
| Air supply hole 16C diameter | 0.250 in. |

-continued

| | |
|---|---|
| Nozzle 16D width | 0.038 in. |
| Screw hole 16E diameter | 0.187 in. |
| Top end block 17 diameter | 3 in. |
| Top end block 17 thickness | 0.375 in. |
| Bottom end block 18 diameter | 3 in. |
| Bottom end block 18 thickness | 0.500 in. |

Preferably, the ratio of the area of the nozzle 16D to the yarn orifice is approximately 1:6 The preferred ratio of the width of the nozzle 16D to the width of the air channel 16B is 1:3.

A typical process using the twist-inserting apparatus 15 according to the preferred embodiment of this invention is as follows:

| | |
|---|---|
| Yarn ends | 6 |
| Yarn count | 1380 den/4 ply |
| Yarn type | Nylon |
| Yarn speed | 400 yds/min |
| false tpi | 3 |
| air psi | 80 |
| dist. between twist reversals | 48 in |

If fewer than 6 yarns are to be processed, it is a simple matter to disconnect the appropriate air supplies and reset the solenoids controlling the sequencing of the air supply delivery. It is also possible to use disks of different thicknesses to vary the manner in which the yarn is twisted. In other words, two identical disks each having a thickness different that specified above can be used and, as well, one disk having a predetermined thickness can be used together with a disk which is identical in arrangement of the various holes, nozzles, etc., but of a different thickness to alter the size of the air-carrying passages. Alternatively, two or more identical disks 16 can be stacked to provide greater air flow for one or the other direction of twist. Thus, in a given application three disks—one applying Z-twist and two applying S-twist could be used. Other combinations are also possible. The thinner the disks, the greater the number of disks which can be used. This would permit a finer degree of variation between the thickness of the S-twist and Z-twist disks.

The top and bottom end blocks 17 and 18 may be made from the same stainless steel as are the disks 16, 16', or may be made from aluminum or other suitable metal. The thickness of the end blocks 17 and 18 is determined principally by the strength needed to prevent deformation of the disks 16, 16', provide mass sufficient to prevent vibration or oscillation during use, and to provide sufficient size for proper mounting. Note that the bottom end block has only screw holes 18A.

Referring now to FIG. 10, a section of the plied yarn 11 is illustrated schematically in further detail. The plied yarn 11 is comprised of a "S"-twisted portion 11A, and an "Z"-twisted portion 11B separated by a twist reversal segment 11C constructed of entangled fibers in the manner described below. The spacing of these twist reversal segments 11C is a significant factor in the ultimate characteristics of the yarn. The twist in the yarns 11 is locked into the yarn in the alternate directions by the twist reversal segments 11C.

Figure 11:
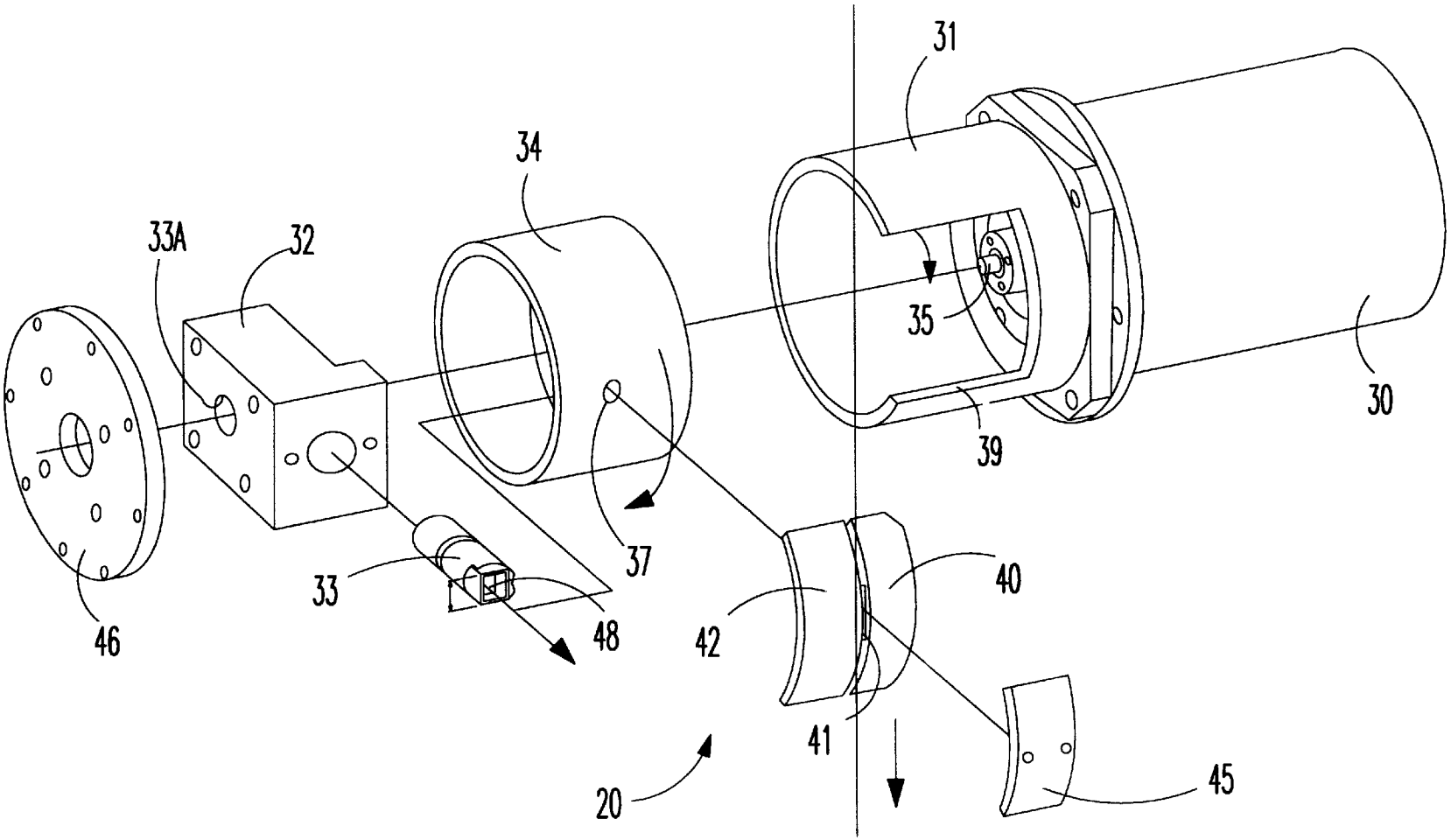
FIG. 11 is an exploded view of a rotary air-jet assembly which may be used with the twist-inserting apparatus according to an embodiment of the invention.

Referring now to FIG. 11, the rotary air-jet assembly 20 is shown in an exploded view. A drive motor 30 is mounted on the machine frame (not shown). A protective shroud 31 is positioned on one side of the motor 30 and encloses several components of the rotary air-jet assembly 20. A manifold housing 32 is mounted in shroud 31 and carries an air manifold 33 which supplies pressurized air to the rotary air-jet assembly 20. Air is supplied to the manifold by an air inlet port 33A. A rotating, cylindrical air-jet carried for rotation on the motor shaft 35 of the drive motor 30. Alternatively, the air-jet nozzle 34 may be driven by a belt, gear transmission or other suitable power transmission device. Rotating nozzle 34 is provided with an air-jet orifice 37 through which air may pass at predetermined intervals.

Shroud 31 is provided with a cut-away section 39 defined by the walls of shroud 31, into which is placed a yarn twister plate 40. Yarn guide plate 40 is provided with a vertically-oriented yarn slot 41 through which the plied yarns 11 pass after leaving the twist-inserting apparatus 15. A yarn slot orifice 42 in the yarn slot 41 communicates with the air-jet nozzle 34. The yarn guide plate 40 fits over the cut-away section 39 to guide the plied yarn 11 properly past the air jet nozzle 34.

A cover 45 is positioned over the yarn slot 41 of the yarn guide plate 40 to prevent uncontrolled escape of air from the proximity of the yarn 11 and to produce in cooperation with the yarn guide plate 40 the air turbulence which entangles the yarn 11. The cover 45 has an upstream yarn entrance 45A and a downstream yarn exit 45B. An end cap 46 encloses the end of the shroud 31. Note that the air-jet nozzle 34 is the only moving part of the air jet assembly 20 other than the shaft and associated elements of the motor 30.

Figure 12:
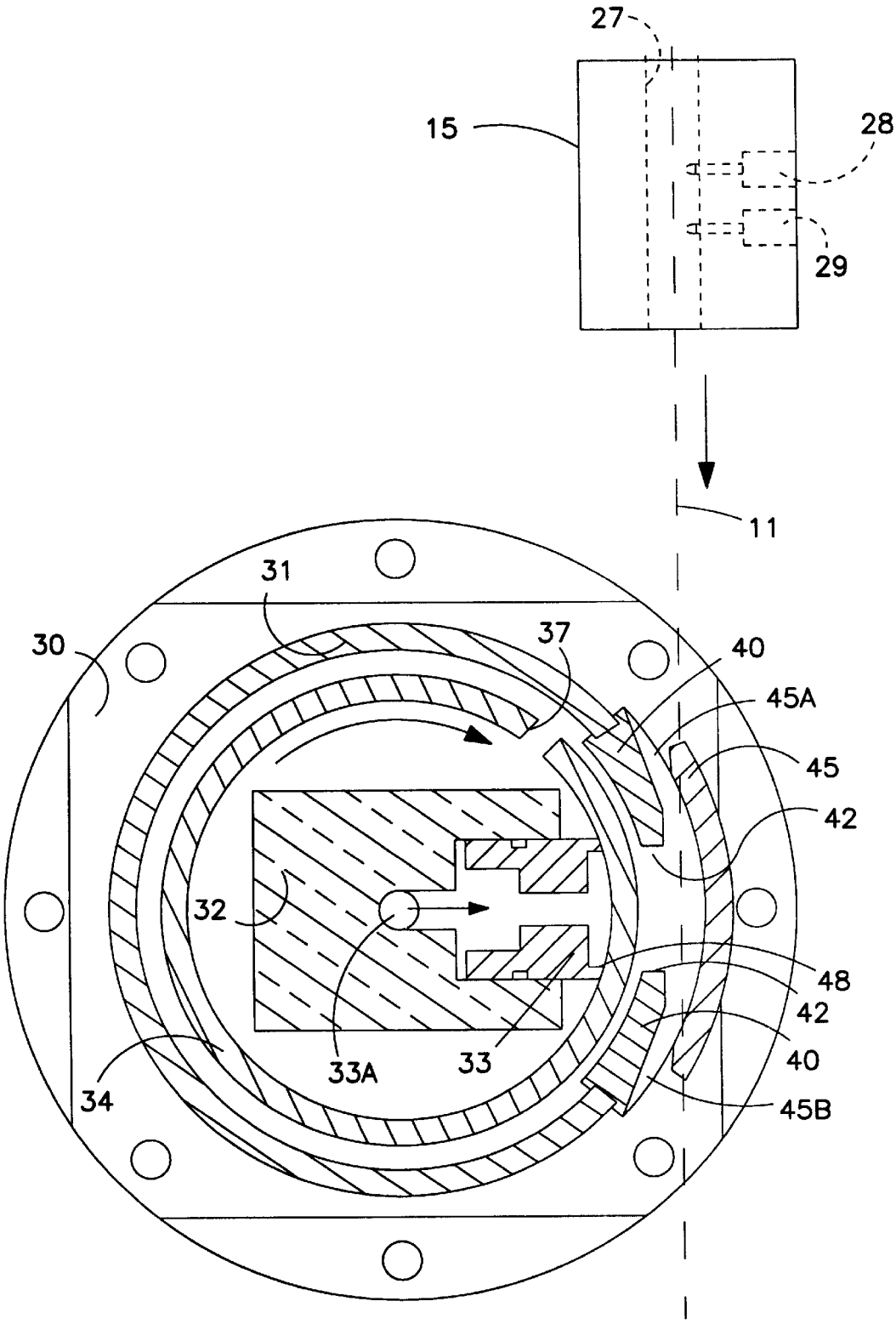
FIG. 12 is a cross-section through a rotary air-jet assembly having one air-jet orifice.

Referring now to FIG. 12, the air-jet assembly 20 is shown in vertical cross-section. Air inlet port 33A feeds pressurized air into the manifold 33. Air is ejected from the manifold through an air outlet port 48. The forward walls of the manifold 33 defining the air outlet port 48 are arcuately-shaped to seal against the inside wall of rotating air-jet nozzle 34 to prevent air from escaping into the interior of the air-jet nozzle 34. As the air-jet nozzle 34 rotates, the air-jet orifice 37 moves past the air outlet port 48. Each complete rotation thus creates a pulse of pressurized air which passes though the air outlet port 48, the air-jet orifice 37, the yarn slot orifice 42 and into the yarn slot 41 in the yarn guide plate 40. The distance between the air-jet nozzle 34 and the yarn guide plate 40 should be as short as possible in order to achieve a short, dense twist reversal segment 11C.

In the position shown in FIG. 12, the air-jet orifice 37 is not aligned with the yarn slot orifice 42 and thus air does not exit to the yarn slot 41, and air cannot entangle the yarn 11.

Figure 13:
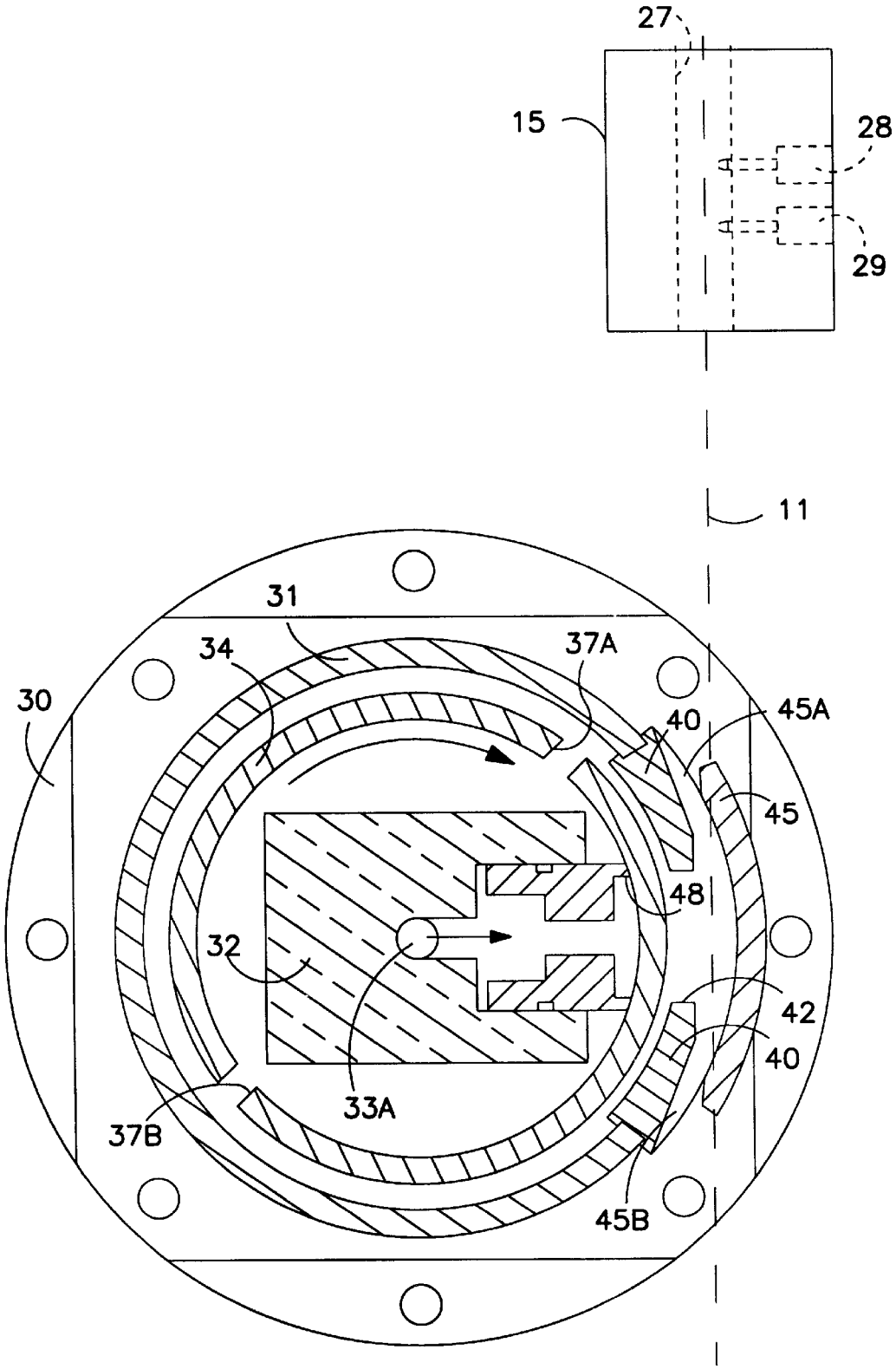
FIG. 13 is a cross-section through a rotary air-jet assembly having two air-jet orifices.

As is shown in FIG. 13, two air-jet orifices 37A and 37B can be formed in the air-jet nozzle 34, thus permitting the formation of two twist reversal segments 11C for each rotation of the air-jet nozzle 34. Other arrangements are possible, and need not be symmetrical. For example, twist reversal points which are at varying distances from each other can be created by selective placement of air-jet orifices 37 at different spacings around the circumference of the air-jet nozzle 34.

Figure 14:
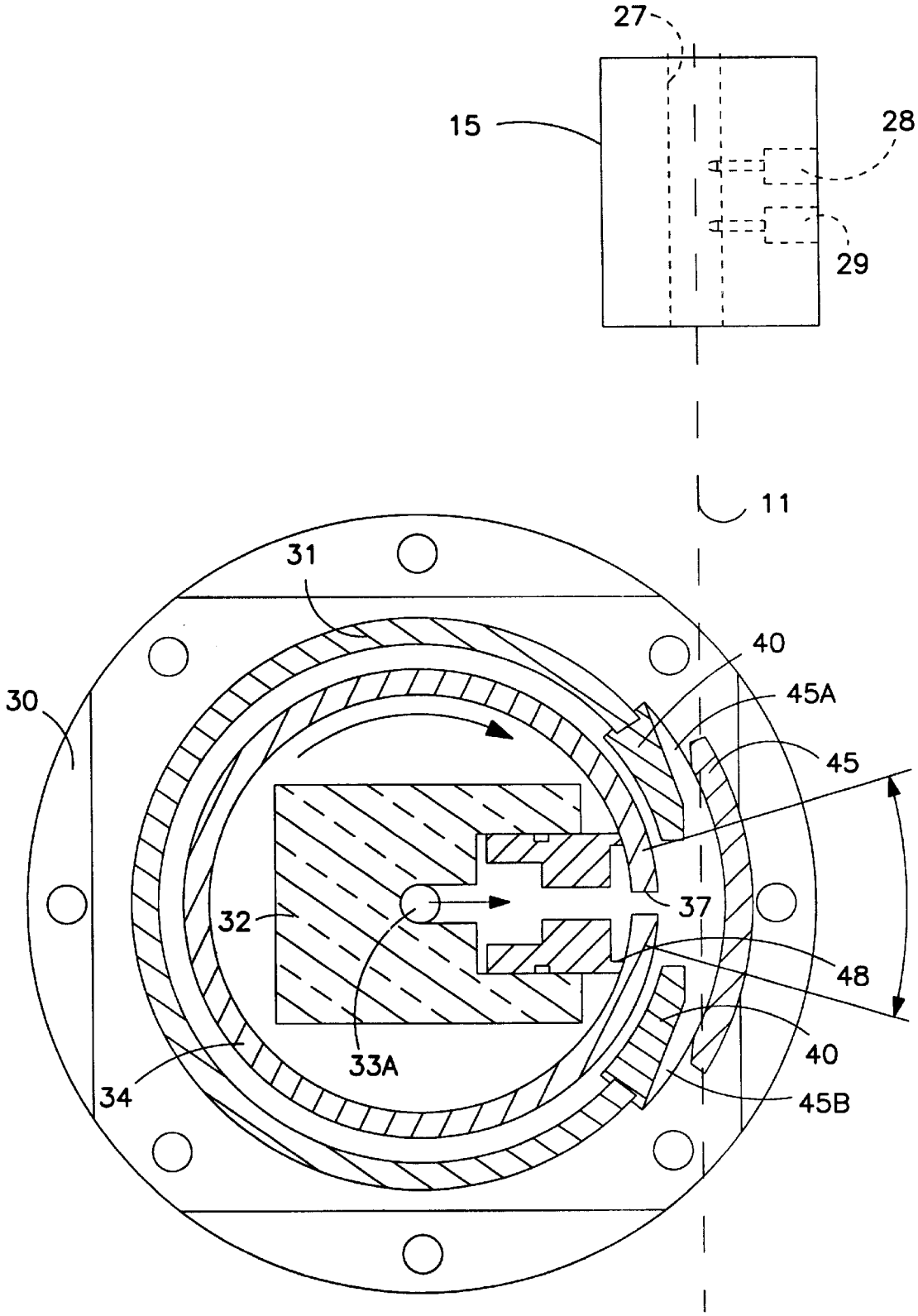
FIG. 14 is a cross-section through air-jet assembly shown in FIG. 12, with air escaping for the fiber entangling action.
Figure 15:
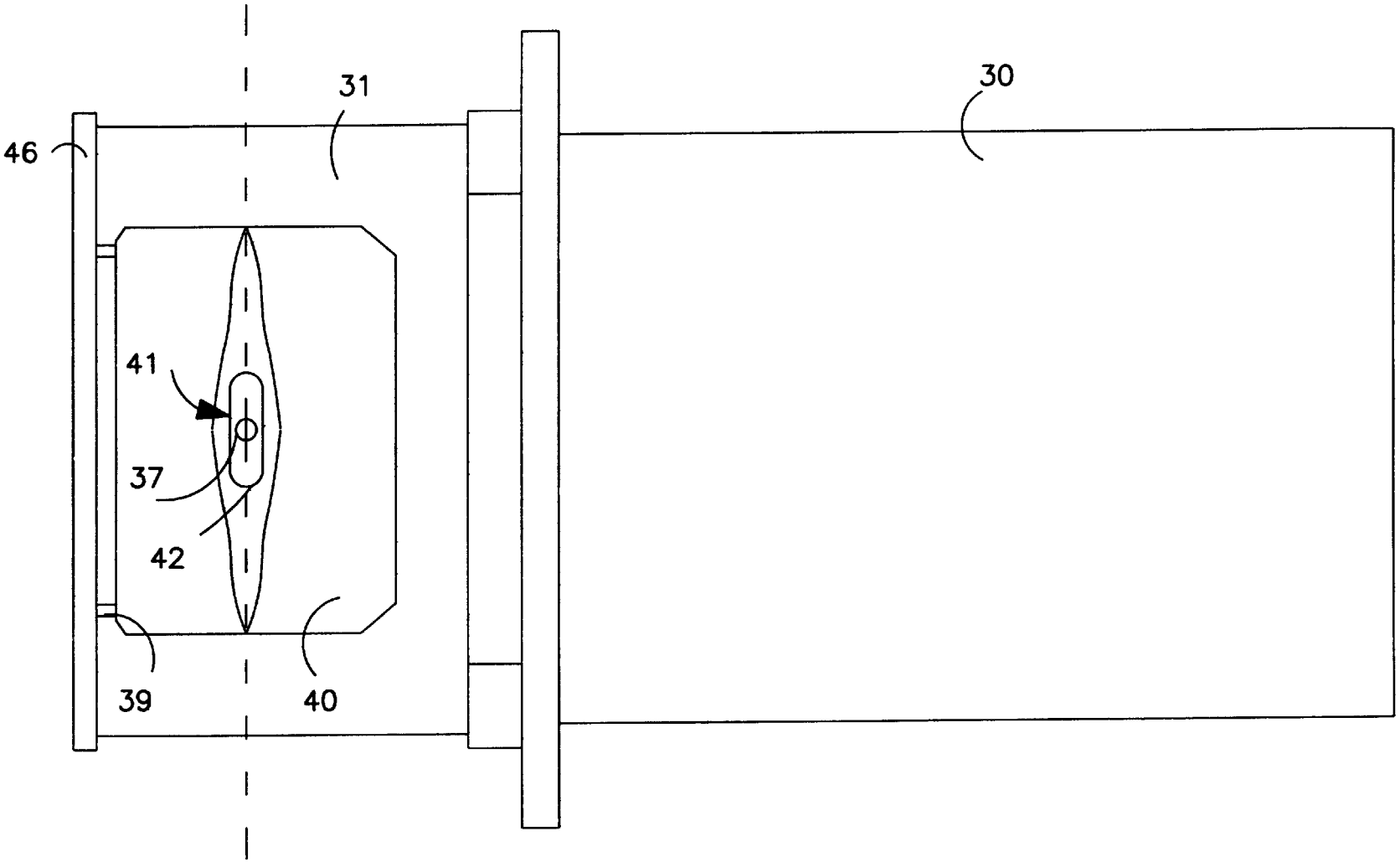
FIG. 15 shows in front view the rotating air-jet orifice in centered position.

FIGS. 14 and 15 illustrate the twist reversal formation position of the air-jet nozzle 34. The air-jet orifice 37 communicates for passage of pressurized air from the air-jet orifice 37 into the area of the yarn 11 by passing into the area of the yarn slot 41. The inside wall of the cover 45 acts as diffuser to create randomly swirling jets of high-pressure, high velocity blasts of air which pass in and through the yarn 11, tangling the yarn 11 at the point where the yarn 11 is exposed to the air blast and forming the twist reversal segments 11C.

If the yarn 11 is traveling with the same velocity as the air-jet nozzle 34, the air-jet nozzle 34 will entangle a given spot on the yarn 11 for each passage of the air-jet orifice 37 past the yarn slot 41. In this circumstance, the length of the twist reversal segment 11C should be approximately no more than the length of the yarn slot orifice 42. By increasing or decreasing the velocity of the air-jet nozzle 34 relative to the velocity of the yarn 11 through the yarn slot 41 and past the yarn slot orifice 42, the size of the twist reversal segments 11C can be controlled with a very high degree of precision.

In FIG. 15, the cover 45 is removed to show the position of the air-jet orifice 37. Note that in this view the air-jet orifice 37 is laterally centered with reference to the yarn slot orifice 42. In this position the air blast will create a generally symmetrical tangle of fibers in the yarn 11—neither favoring the Z-twist or S-twist direction.

Figure 16:
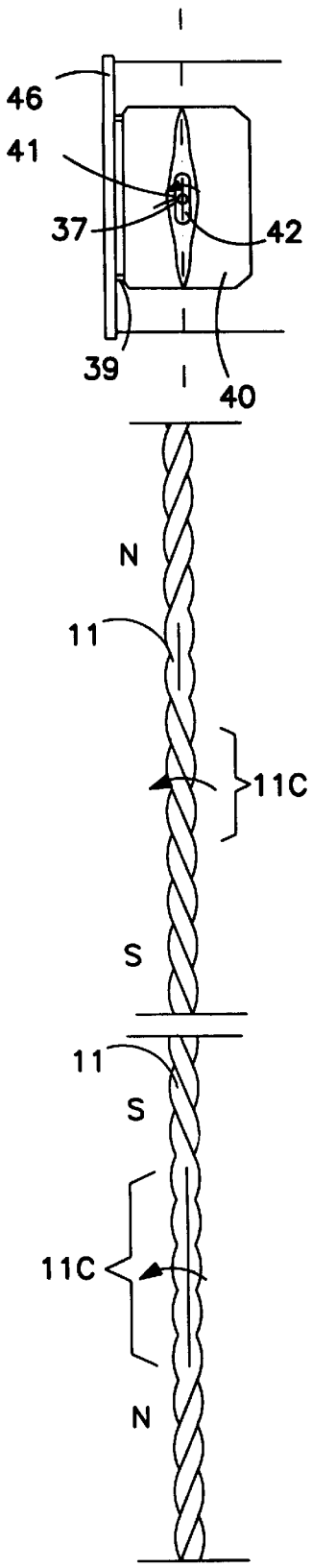
FIG. 16 shows in front view the air-jet orifice in an off-centered position with its effect on the two different yarn reversals.

In FIG. 16 (top section) the air-jet opening has been laterally shifted to the right in relation to the yarn slot orifice 42. The result of this displacement of the air-jet orifice 37 is that the air blast helps the self-twisting action of the plied yarn 11 when it changes from Z-twist to S-twist, resulting in a very short twist reversal segment 11C. See middle section of FIG. 16.

However, if the plied yarn 11 changes from S-twist to Z-twist the off-center air-jet orifice 37 partially untwists the plied yarn 11, resulting in a longer twist reversal segment 11C of lower twist. See bottom section of FIG. 16.

Figure 17:
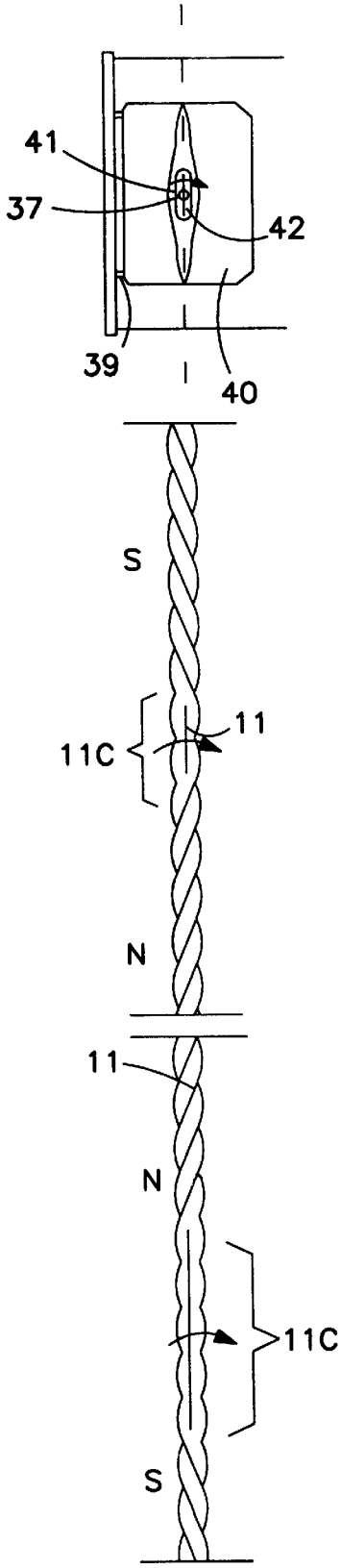
FIG. 17 shows in front view the air-jet orifice in an off-centered position toward an off-centered position opposite that in FIG. 16, with its effect on the two different yarn reversals.

FIG. 17 shows how the opposite occurs when the air-jet orifice 37 is moved laterally off center to the left. The proper arrangement for a short point of twist reversal is to use an air-jet nozzle 34 with two air-jet orifices 37A and 37B (FIG. 13) where one air-jet orifice 37A or 37B is laterally offset to the right of the yarn slot orifice 42 to entangle the plied yarn 11 when the twist changes from "Z" to "S"; and use the other of the air-jet orifices 37A or 37B, which is offset to the inside of the yarn slot orifice 42, to entangle the plied yarn 11 when the twist changes from "S" to "Z".

Figure 18:
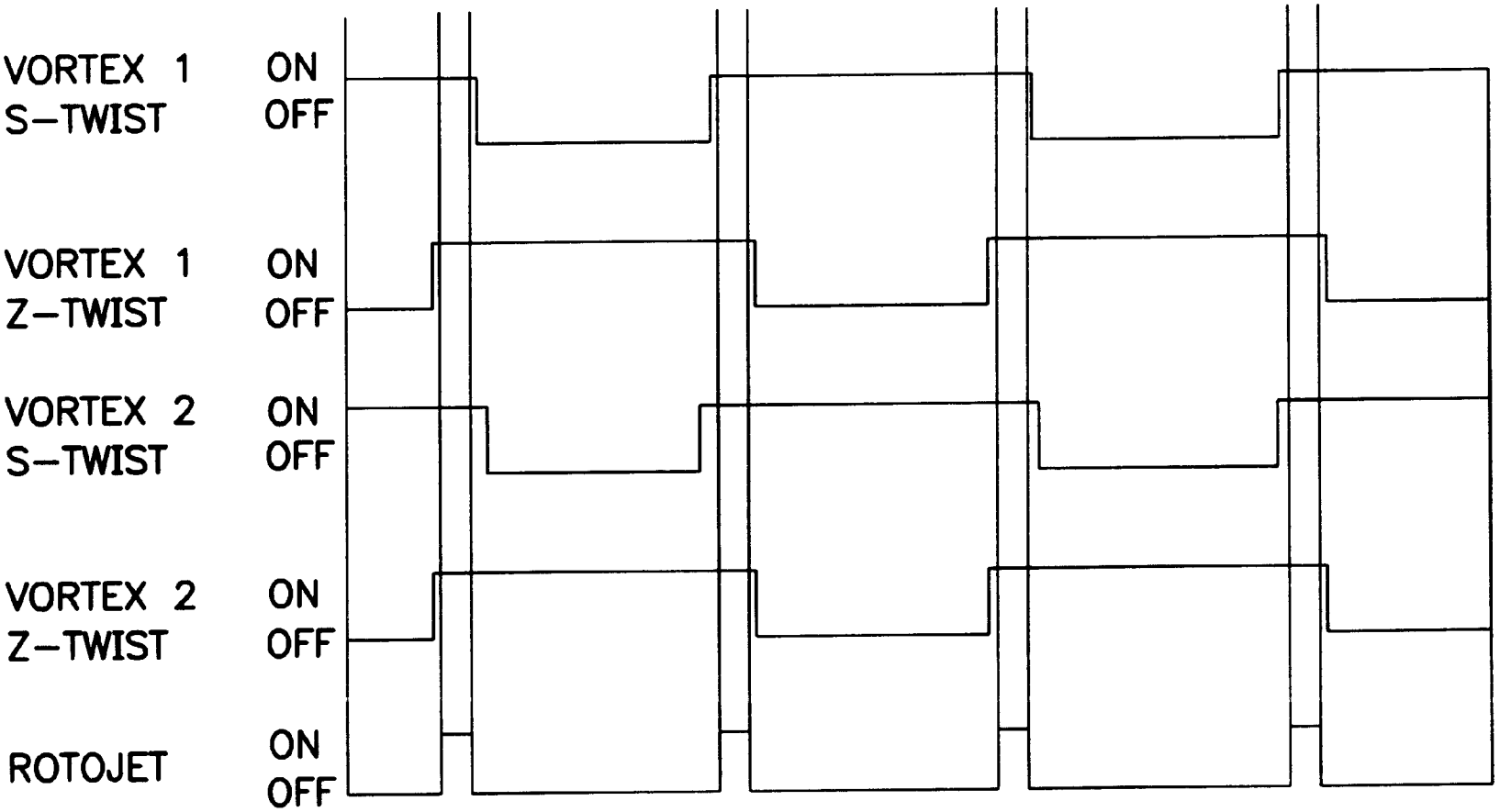
FIG. 18 is a timing diagram of the input and output of the electronic controller for an air-jet nozzle having one air-jet orifice.

Referring now to FIG. 18, the table illustrates that the active air-blast time of the rotary air-jet assembly 20 is used to time the "on" and "off" time of the twist-inserting apparatus 15 for a air-jet nozzle 34 with a single air-jet orifice 37. It should be noted that the air for the S-twist air supply holes 16C of the twist-inserting apparatus 15 is turned on before the air for the Z-twist air supply holes 16F is turned off. This is accomplished through electronic timing. The same type of timing is also used for the alternating air supply which inserts the S-twist and Z-twist at the twist-inserting apparatus 15. This overlapping timing can be used if desired to achieve a short as possible twist reversal segment 11C in the plied yarn 11 since there is some unavoidable delay in the time from when the solenoid is switched on until the air is fully active in the twist-inserting apparatus 15.

Figure 19:
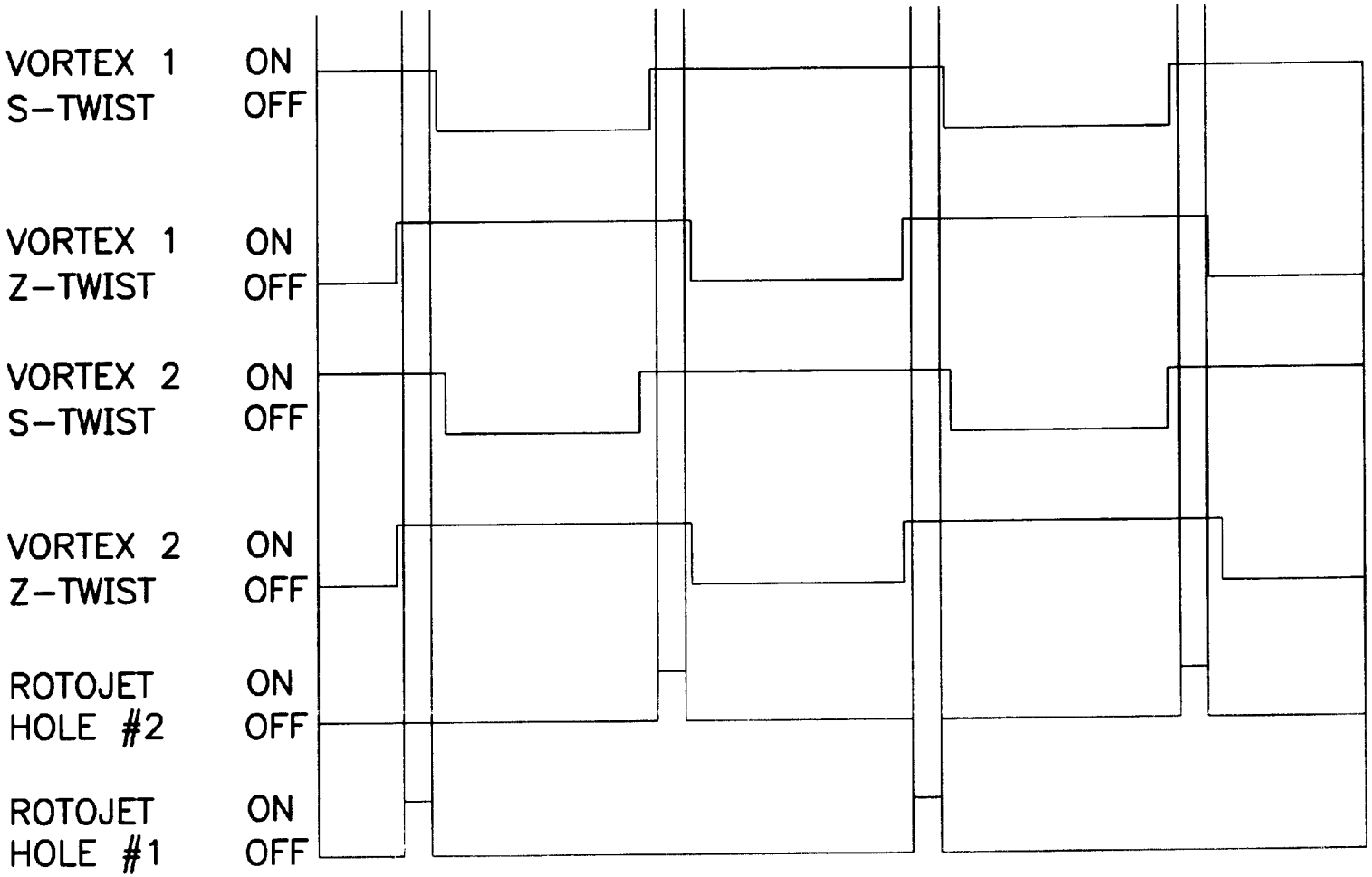
FIG. 19 is a timing diagram of the input and output of the electronic controller for an air-jet nozzle having two air-jet orifices.

FIG. 19 shows the timing for a rotary air-jet assembly 20 with an air-jet nozzle 34 having the two circumferentially-offset air-jet orifices 37A and 37B (FIG. 13) where the two air-jet orifices 37A and 37B are laterally offset to each other and are laterally displaced from the center of the yarn slot orifice 42 to accomplish a short twist reversal segment 11C.

Figure 20:
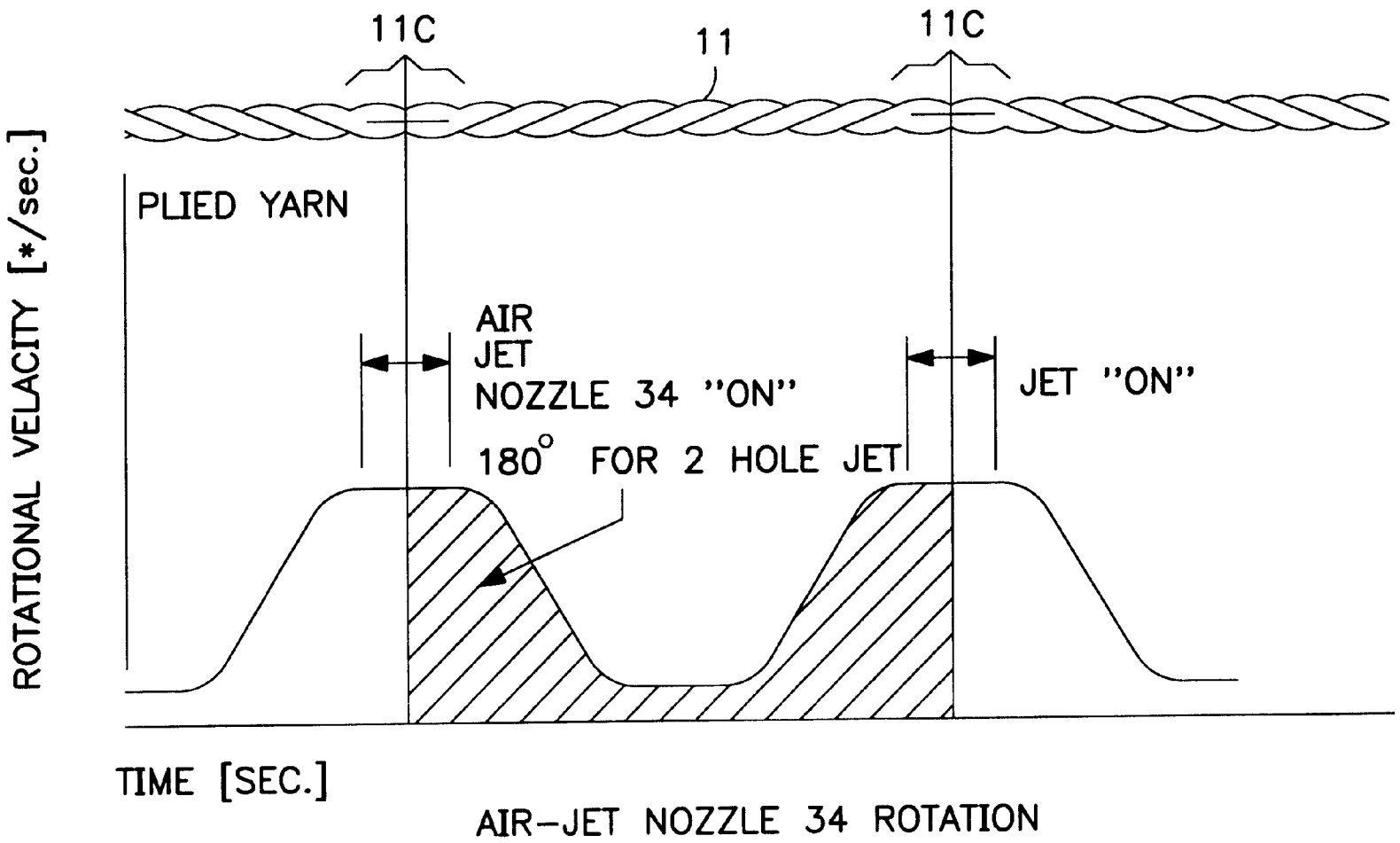
FIG. 20 is a chart showing the timing of the air-jet orifice in relation of the point of twist reversal in the processed yarn.

The timing diagram in FIG. 20 shows how the rotational speed of the rotary air-jet assembly 20 is controlled. An electronic drive (not shown) for the rotary air-jet assembly 20 is programmed in such a manner that the air-jet orifice 37 reaches the velocity of the traveling plied yarn 11 during the time that entangling of the yarn 11 is taking place. The rotational speed of the air-jet nozzle 34 with its air-jet orifice 37 is slowed down between each splicing cycle in order to wait for the next twist-reversal, at which time it has been brought up speed to match the velocity of the plied yarn 11.

The desired yarn-length between the twist reversal segments 11C and the processing speed of the yarn 11 dictates the velocity profile of the rotary air-jet assembly 20. The relationship of the rotary air-jet assembly 20 in relation to the plied yarn 11 is given in FIG. 20. The rotational velocity of the air-jet nozzle 34 is timed in two basic ways:

First, the air blast from the air-jet orifice 37 is timed to coincide with the passing of the point where the twist reversal segment 11C of the yarn 11 is to be formed. Secondly, the rotational speed of the air jet nozzle 34 matches the velocity of the traveling yarn 11 in order that the air blast is, relatively speaking, stationary with the point of creation of the twist reversal segment 11C during the entangling process. The shaded area shown below the rotational velocity line in FIG. 20 is the integral of the rotational velocity and the process time and is equal to the angular distance between two air-jet orifices 37A and 37B of the rotary air-jet assembly 20 shown in FIG. 13. The electronic controller for the drive motor 30 of the rotary air-jet assembly 20 is not shown, but may be a known angular encoder on the drive motor 30. It is naturally understood that the distance between the twist reversal segments 11C can be changed through the electronic controller, which will automatically adjust the speed of the drive motor 30 and hence of the air-jet nozzle 34 to match the requirements of the system to cause tangling of the yarn 11 at the desired points of twist reversal, and matching of the velocity of the air-net nozzle 34 with the velocity of the traveling yarn 11.

Alternatively, the electronic control of the rotary air-jet assembly 20 may be by an encoder on the drive of the take-up winder 25 (FIG. 1), which is then used as the master input for the electronic control, and from which the location of the point of twist reversal and the point where the yarn 11 is entangled is determined.

Other variations are also possible, including controlling each of several rotary air-jet assemblies 20 independently by utilizing different reversal timing, by preventing air to one or more air-jet orifices 37 for a given time, or by having an opposite twist action take place in one or more of the air-jet nozzles 34.

Figure 21:
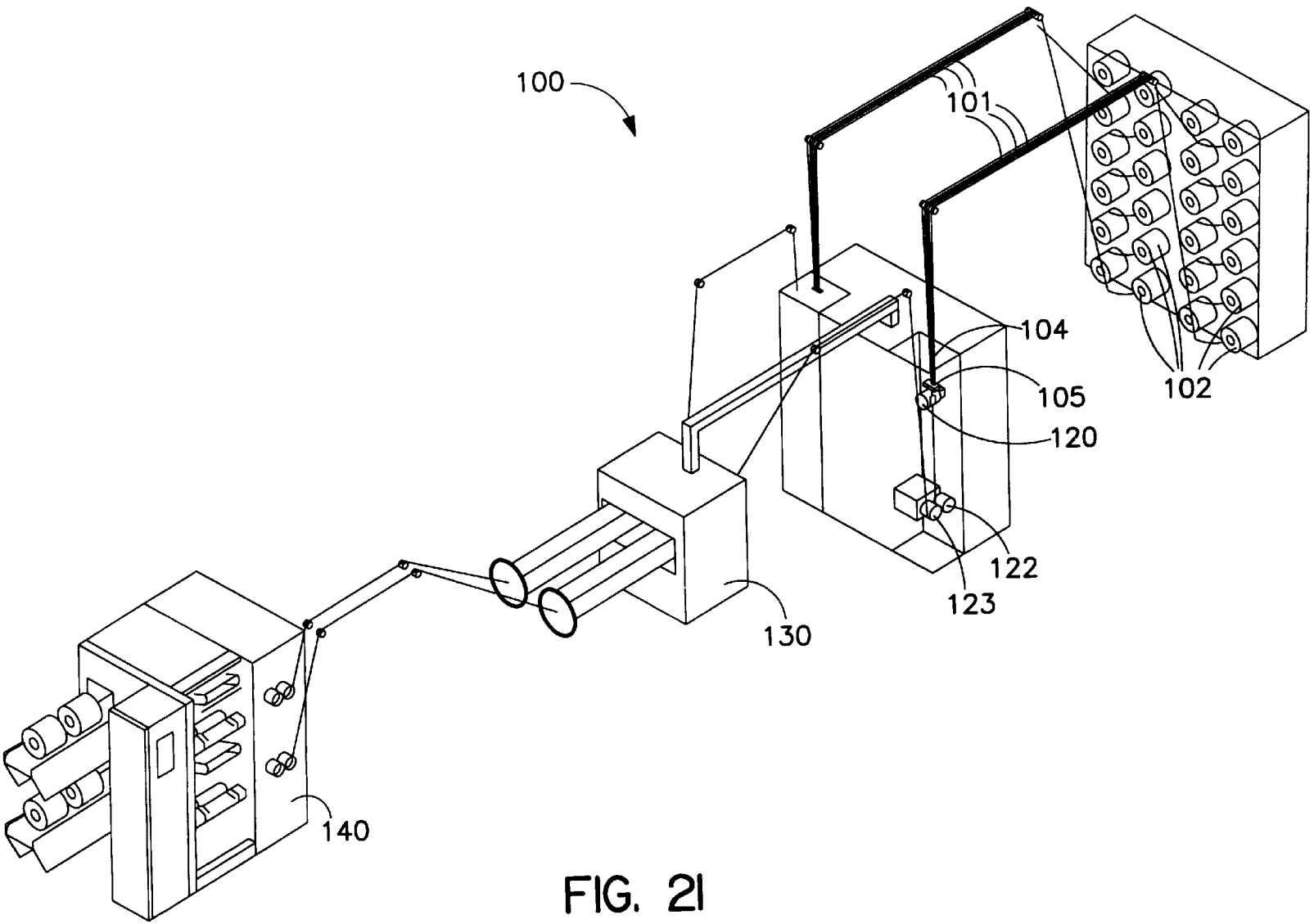
FIG. 21 is a simplified, schematic, perspective view of a fluid-jet false-twisting apparatus according to another embodiment of the present invention.

Referring now to FIG. 21, a fluid-jet false-twisting apparatus according to another embodiment of the invention is shown and generally indicated at broad reference numeral 100. In general, multi-filament yarns 101 are taken from respective supply packages 102 and passed through a yarn separator 104, four twist-inserting air-jets, referred to as "twist-inserting apparatus 105" (one for each yarn 101) and a rotary air jet assembly 120, where the yarns 101 are plied by the combined action of the twist-inserting apparatus 105 and the rotary air jet assembly 120 in the manner described above in relation to FIGS. 1–20. Air is supplied to the twist-inserting apparatus 105 from a source of pressurized air by means of solenoid valves controlled by mechanical, electromechanical or, preferably, electronic means (not shown).

The yarns 101, now in plied form, are guided around overfeed drive rolls 122, 123 where the tension on the plied yarns 101 is reduced to a predetermined extent before delivery to a yarn accumulator 130 and to a downstream take-up winder 140. The yarn accumulator may be a Belmont Model AC-50 accumulator, and the winder may be a Model AD-25 take-up winder. The yarn accumulator 130 helps buffer variations in yarn tension, and permits the system to continue operating during package changes. In addition, any lengths of defective yarn can easily be seen in the accumulator and removed during machine operation. The accumulator 130 may act as the "master encoder" for purposes of determining actuation of the various twist inserting and entangling functions described above. Alternatively, the overfeed drive rolls 122, 123 may be removed and replace with a nip roll (not shown), in which case the nip rolls may be used as the constant speed master off of which the other functions of the fluid-jet false-twisting apparatus 100 are timed.

An apparatus and method for twisting individual strands of yarn and plying these individually twisted strands around each other is described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A method for inserting twist into a moving strand, comprising the steps of:

(a) providing first and second discs, each of which include:

(i) an orifice extending therethrough for permitting passage of a moving yarn;

(ii) an air channel extending therethrough and communicating with said orifice at a tangentially-offset angle to the path of the yarn through the orifice to create a cyclonic air circulation pattern in the orifice to insert a predetermined direction of twist into the yarn as the yarn passes through the orifice;

(b) inverting said first disk relative to said second disk and placing said first body in overlying mating alignment with said second disk;

(c) passing a strand of yarn through an orifice in said first disk and an aligned orifice in said second disk;

(d) directing a cyclonic air circulation pattern into an orifice in the first disk in a first predetermined direction for inserting a corresponding first direction of twist into the yarn;

(e) directing a cyclonic air circulation pattern into an orifice in the second disk in a second predetermined direction for inserting a corresponding second direction of twist into the yarn.

2. A method according to claim 1, and including the steps of:

(a) extending the orifice in an axial direction through said disk; and (b) extending at least a portion of said air channel radially through said disk.

3. A method according to claim 1, and including the steps of:

(a) providing a plurality of spaced-apart orifices; and (b) providing a plurality of air channels, one of said plurality of air channels communicating with a respective one of said orifices.

4. A method according to claim 1, wherein said air channels extend through the thickness of the disk and communicate with opposed first and second major surfaces thereof.

5. A method according to claim 1, wherein said first and second discs have different predetermined respective thicknesses for accommodating an air channel having a larger or smaller air flow capacity whereby first and/or second disks can be substituted to increase or decrease the air flow capacity required for a given yarn size, configuration or level of twist insertion.

6. A method according to claim 1, and including the step of reversing at predetermined intervals.

7. A method according to claim 1, and including the step of controlling the insertion of twist by means of compressed air supplied by twist-inserting air-jets connected to solenoid valves, which are controlled through an electronic controller.

8. A method according to claim 1, and including the step of varying the amount of twist in one or more yarns being twisted.

9. A twist insertion device for a textile machine, and comprising:

(a) a disc having a plurality of yarn orifices formed in a central area of the the disks for allowing yarns to pass through the orifices perpendicular to a major plane of said disk;

(b) a plurality of air channels formed in the body and extending radially-inwardly from a plurality of enlarged air supply holes;

(c) a plurality of nozzles interconnecting said yarn orifices with respective ones of said nozzles at a tangent, whereby air traveling from a nozzle into an interconnected orifice creates a cyclonic air circulation pattern with sufficient energy to cause the moving yarn to be twisted about its own axis; and (d) air supply holes for supplying air to said air channels.

10. A twist insertion device according to claim 9, wherein the orifices air channels, air supply holes and nozzles are cut into the body of the disk and communicate with both major surfaces of the body.

11. A twist insertion device according to claim 9, and including multiple ones of said disks positioned in overlaying, aligned relation to each other for reversing the tangent angle at which the air from the nozzles intersect the moving yarn.

* * * * *